United States Patent [19]

Cornelison

[11] Patent Number: 4,838,067

[45] Date of Patent: Jun. 13, 1989

[54] CORROSION RESISTANT CORRUGATED METAL FOIL FOR USE IN WOUND AND FOLDED HONEYCOMB CORES

[75] Inventor: Richard C. Cornelison, Hiram, Ohio

[73] Assignee: W. R. Grace & Co.-Conn., New York, N.Y.

[21] Appl. No.: 50,412

[22] Filed: May 18, 1987

[51] Int. Cl.[4] ..... B21D 13/04; B21D 13/10

[52] U.S. Cl. ..... 72/196; 72/379; 29/157 R

[58] Field of Search ..... 72/185, 186, 187, 196, 72/197, 379; 29/157 R; 493/352, 463; 428/593, 595, 182–186, 604; 422/180, 181

[56] References Cited

U.S. PATENT DOCUMENTS

| | | | |
|---|---|---|---|
| 1,868,302 | 7/1932 | Auger | 72/196 |
| 2,896,692 | 7/1959 | Villoresi | 428/183 |
| 3,992,162 | 11/1976 | Gewiss | 428/604 |
| 4,711,009 | 12/1987 | Cornelison et al. | 72/196 |
| 4,748,838 | 6/1988 | Cornelison | 72/185 |

FOREIGN PATENT DOCUMENTS

| | | | |
|---|---|---|---|
| 1656 | 1/1967 | Japan | 72/196 |
| 78720 | 5/1984 | Japan | 72/370 |
| 715193 | 2/1980 | U.S.S.R. | 72/196 |

OTHER PUBLICATIONS

European Patent Application, Jan. 1983, Miura et al., 10 pages of spec. and 4 sheets of dwg. figures.

European Patent Application, Aug. 1985, Stevenson et al., 13 pages of spec. and 3 sheets of dwg. figures.

*Primary Examiner*—Lowell A. Larson

*Attorney, Agent, or Firm*—Steven T. Trinker

[57] ABSTRACT

There is provided a method for inhibiting corrosion at elevated temperatures of a nonnesting accordion folded or wound corrugated thin metal strip. The strip is corrugated with a longitudinally running series of peaks and valleys by passing the strip through a set of corrugating gears, each of the corrugations including one longitudinally extending displacement deviating from and returning to an imaginary line extending between the longitudinal marginal edges of the strip. The corrugations are characterized further in that the deviation extends in the direction of movement of the strip through the corrugating gears and is first to enter and exit from such gears. This places the maximum of the deviation in compression which has been found to minimize corrosion, e.g., from the pollutants contained in the exhaust from an internal combustion engine.

3 Claims, 1 Drawing Sheet

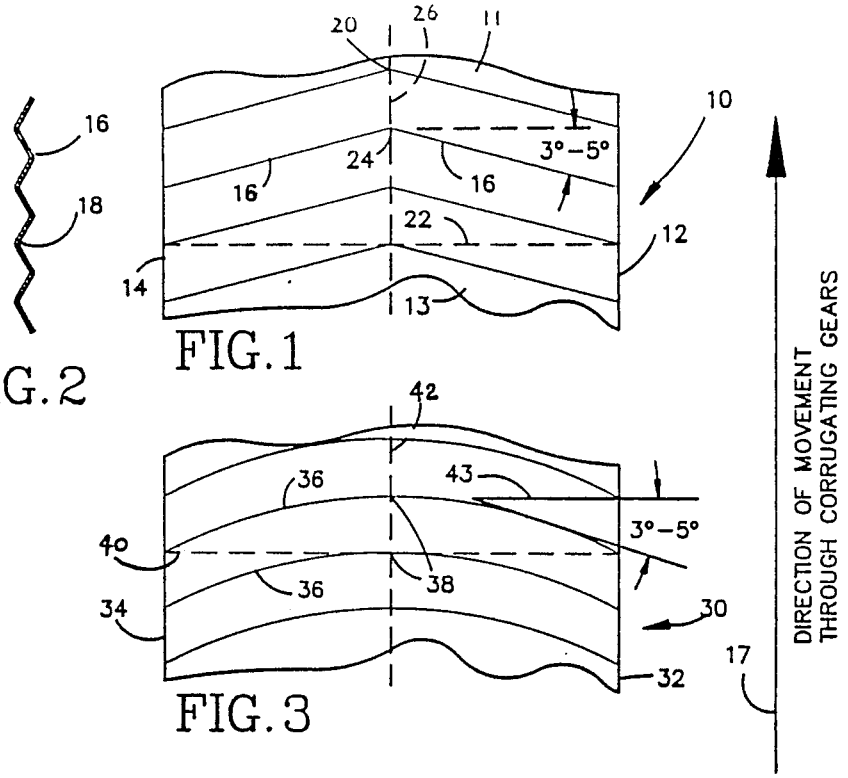
FIG. 1
FIG. 2
FIG. 3
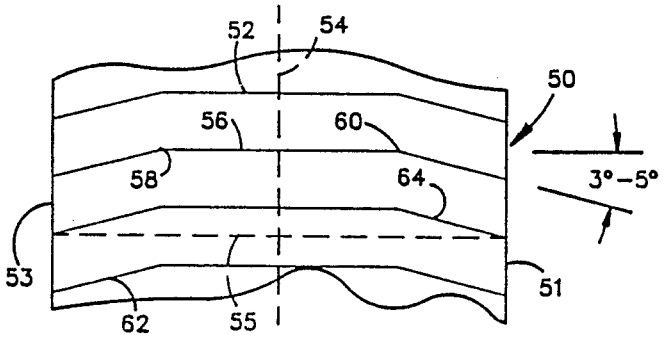
FIG. 4
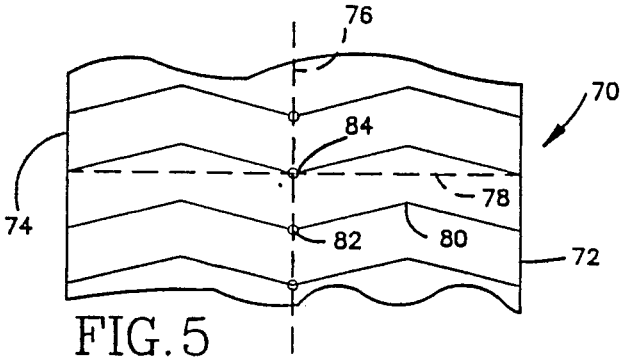
FIG. 5
(PRIOR ART)

CORROSION RESISTANT CORRUGATED METAL FOIL FOR USE IN WOUND AND FOLDED HONEYCOMB CORES

This invention relates to the field of wound and folded honeycomb cores especially useful in catalytic converters, diesel traps, recuperators, diffusers and similar applications.

BACKGROUND OF THE INVENTION AND PRIOR ART

Since 1970 there has been an increasing demand for honeycomb cores that have structural integrity after operating for periods ranging upwards to 5000 hours in hot, cyclic corrosive atmospheres, such as found in the exhaust of spark-ignited or compression ignited internal combustion engines, e.g., diesel engines and turbines.

Honeycomb cores used in these applications can be coated with catalytic materials and used as catalytic converters, such as disclosed in U.S. Pat. No. 4,711,009, incorporated herein by reference. Alternately, such cores can be coated to resist hot, cyclic corrosion and can serve as diesel-engine particulate traps, recuperators or diffusers.

Honeycomb cores are made either spirally wound or accordion folded. Some of the prior art cores are comprised of alternating flat and corrugated substrate layers. Alternately, the cores can be made of adjacent layers of corrugated substrate of minimal thickness, e.g., 0.001" to 0.010" ("thin metal") can containing a pattern such that nesting of the corrugations in adjacent layers does not take place. For example, a herringbone or sine wave pattern in the substrate will not nest with itself when the substrate is folded back on itself. Furthermore, nesting will not take place when one of a pair of wave-pattern substrates is turned over or turned end for end and wound against the other one of the pair.

In the mass production of honeycomb cores, it is important that nesting does not take place, because if the adjacent corrugations next together, then the overall cross section of the core normal to the corrugated laminations is reduced, which leads to looseness of the core in the containment vessel. This subsequently can lead to vibration of unsupported laminations. Vibration of laminations leads to cyclic failure of sections of the core and finally to catastrophic failure of the core as a whole.

Further, in the mass production of honeycomb cores it is essential to keep material usage at a minimum, because the substrate material is costly, especially in relation to the cost of the most commonly-used ceramic substrates. Twenty percent less substrate is needed for a given core size if the core construction consists of alternate layers of substrate with patterned corrugations positioned between layers of similarly-formed corrugations but juxtapositioned by 180°, so as not to nest, which is known as "mixed-flow cell construction"or a "mixed flow core".

Mixed-flow cell construction has the further advantage that greater contact is made with molecules of fluids as they strike the inclined cell walls and are catalyzed by catalysts carried by the cell-walls in the core, in comparison with straight, annular cells.

While nesting is not an issue with adjacent flat and corrugated substrate laminations, nesting can be a serious problem, for the reasons described above, in the case of mixed-flow cell construction. Nonetheless, mixed-flow construction has, on balance, so many advantages compared with annular cell construction that it is used increasingly for mass-produced honeycomb cores.

Mr. James R. Mondt has described a herringbone pattern for a recuperator in U.S. Pat. No. 3,183,963, issued May 18 1965, "Matrix for Regenerative Heat Exchangers". Chapman has described a herringbone pattern in U.S. Pat. No. 4,318,888, "Wound Foil Structure", which when formed into a core will not nest. Cairns has described in U.S. Pat. No. 4,098,722, "Methods of Fabricating Bodies", a variable-pitch corrugation whereby adjacent faces will not nest. In U.S. Pat. No. 4,753,919 to Whittenberger, means are described of optimizing the design of mixed-flow sine wave and herringbone patterns in adjacent layers of honeycores, so as not to nest.

The corrugated mixed-flow substrate manufacturing process, as well as the design of corrugation geometry and pattern, must be considered in production of honeycomb cores that are expected to endure the rigors of automotive field service.

The most practical means of manufacturing thin, corrugated substrate is to roll-form strips of metal foil having leading and trailing portions, through opposing intermeshing helical gears. The design of the teeth in the opposing gears dictates the corrugation-pattern, pitch and amplitude of the corrugations impressed in the substrate. The nature of the pattern in turn dictates the internal stresses in the foil substrate. As the substrate is pulled into the rotating, opposed gears, thinning of the substrate occurs wherever the substrate is in tension, or alternately thickening or bunching, where the substrate is in compression.

A method of forming of corrugations between small diameter roll forming gears is explained in my above-identified U.S. Pat. No. 4,711,009, supra.

The nature of the substrate material, is described in Retallick's U.S. Pat. No. 4,402,871, "Metal Catalyst Support Having Honeycomb Structure and Method for Making Same". This substrate, when metal worked through opposing gears, tends to have its outer aluminum coating thinned out, as well as the stainless steel base material, in the regions of the corrugations, where stretching or tensioning take place in the small diameter gear-forming manufacturing process. Another substrate that represents another aspect of the current art in stainless steel metal foil for honeycomb cores (i.e., the aluminum is in the foil and diffuses outward to form an aluminum oxide film) is represented by Aggen and Borneman's U.S. Pat. No. 4,414,023, "Iron-Chromium-Aluminum Alloy and Article and Method Therefor".

In the case of the materials covered by the above two patents, the metal thus formed is alternately stretched and compressed across the width and along the length of the foil, throughout the alternating patterns. In the case of an alternating herringbone pattern, the location of the most stretching and compression are at the apices of the pattern, or where the pattern changes direction.

Undulating, repeating corrugation-patterns, regardless of their geometry, are characterized by alternate apices of compression and tension, whether sine wave, herringbone or any other wave or pattern.

At apices in tension, the metal is thinned, which in addition to producing localized stress risers, creates a site that is prone to hot, cyclic corrosion failure and structural weakness in the core, as described earlier and encountered in the exhaust streams of internal combustion engines, or in the very hot regeneration mode associated with diesel particulate traps and the regenerators for turbine engines.

It is, therefore, a principal purpose of this invention to describe patterns that have a minimum of tension and compression stress risers.

BRIEF STATEMENT OF THE INVENTION

Briefly stated, the present invention is in a method of minimizing failure by corrosion (or prolongling the life) at elevated temperatures of a nonnesting accordion folded or spirally wound corrugated thin metal strip, said strip having longitudinally extending parallel marginal edges, which comprises corrugating said thin metal strip with a longitudinally running series of peaks and grooves by passing said metal strip between corrugating gears, each of said peaks and grooves including a single longitudinally extending displacement deviating from and returning to a line extending between the longitudinal marginal edges of said metal strip, said deviation extending in the direction of movement of said strip through the corrugating gears, whereby the longitudinally extending maximum of the deviation is the first to contact the mating and rolling corrugating gears and is, therefore, in compression.

In more particular embodiments of the present invention, the displacements are from an imaginary line extending perpendicularly between the parallel marginal edges and for most purposes are in the form of a V-shape or chevron shape with the apex, or maximum deviation from said imaginary line, being the first portion to contact the rolling corrugating gears and the first to leave the gears. This places the metal surrounding the apex in compression instead of in tension, which, as will be shown later herein, is a point of failure. The corrugations may also be in a sinusoidal pattern for nonnesting and will display the same kind of failure at the last to leave areas of direction reversal in the pattern.

BRIEF DESCRIPTION OF THE DRAWINGS

The foregoing invention may be better understood by having reference to the annexed drawings wherein:

FIG. 1 is a fragmentary diagrammatic plan view of a corrugated thin metal strip in accordance with the present invention and having V-shaped or chevron shaped corrugations.

FIG. 2 is a cross-sectional view of the strip shown in FIG. 1 showing the peaks and valleys forming or defining the corrugations.

FIG. 3 is a fragmentary diagrammatic plan view of a corrugated thin metal strip in accordance with the present invention and having arcuate peaks and valleys forming or defining the corrugations.

FIG. 4 is a fragmentary diagrammatic plan view of a corrugated thin metal strip in accordance with the present invention having truncated V-shaped or truncated chevron shaped peaks and valleys forming or defining the corrugations.

FIG. 5 is a fragmentary diagrammatic plan view of a conventional corrugated thin metal strip having a plurality of V-shaped or chevron shaped peaks and valleys cross the width of the thin metal strip.

In the foregoing figures, the long arrow to the right of the figures is in the direction of movement of the thin metal strip through the corrugating gears and shows the orientations of the corrugation pattern.

DETAILED DESCRIPTION OF THE INVENTION

As indicated above, it has been found to be of critical importance, in the corrugating of thin metal strip material, including a ferritic material having a very thin coating of aluminum metal thereon, that careful note be taken of the number and direction of changes in direction of the individual corrugations. Such changes in direction or deviations from an imaginary straight line traversing the width of the thin metal strip are essential to the achievement of a nonnesting characteristic, the importance of which has been noted above. Unfortunately, the prior art method of addressing the nesting problem demonstrates a corrosion problem under accelerated corrosion testing (FIG. 5). Undulating, repeating corrugation patterns characterized by alternating apices of points of maximum deviation or displacement to either side of an imaginary straight line across the width of the thin metal, and because of the effect of the rolling of the corrugating gears, generate alternating points of compression and tension. This effect is independent of the geometric shape of the line of the corrugation, whether sine wave, herringbone, or any other wave or repeating pattern.

Tests have shown that those points or regions which are in compression withstand exposure to corrosive conditions much longer than those points which are in tension. In the annexed drawings, FIGS. 1–4 show a number of corrugation patterns that produce various degrees of stress risers. To the extent that even compressive stress risers are present, some degree of corrosion will take place when the corrugated thin metal catalytic substrate (as in a catalytic converter) is subjected to extreme hot cyclic and corrosive environment. Thus, it is not only important to limit the number of discontinuities and the direction in which they are formed, but also the angle of deviation. When these three conditions are observed, best results in terms of resistance to corrosion under extreme exhaust conditions are obtained.

Referring now, more particularly to FIGS. 1 and 2, there is here shown in diagrammatic fragmentary plan and cross-sectional views a preferred embodiment of the present invention. There is provided a thin metal strip 10, desirably a ferritic stainless steel strip, which has been treated in accordance with the process disclosed in U.S. Pat. No. 4,711,009, to form a catalytically active core material for forming a catalyst member useful in treating the exhaust of internal combustion engines. The strip 10 has parallel marginal edges 12 and 14, and in practice comes from a roll of predetermined width, e.g., 4". Corrugations 16 are impressed therein by passing the strip 10 between small diameter segmented and oppositely disposed helical corrugating rolls as fully described in the aforesaid U.S. Pat. No. 4,711,009, the direction of movement through the gears being shown by the line 17 and with the leading portion 11 proceeding through the gear first and the trailing portion 13 following. In the annexed drawings, only the peaks of the corrugations are illustrated except in FIG. 2 wherein the peaks 16 and the valleys 18 are shown. In practice, the pitch from peak to peak of the corrugations is about 2 mm and the depth is about 1 mm.

The peaks 16 in FIG. 1 have a V-shape or chevron shape with but a single deviation 20 from an imaginary straight line 22 extending between marginal edges 12 and 14. In the embodiment shown in FIG. 1, the imaginary straight line 22 is shown dotted and is perpendicular to the marginal edges 12 and 14, a preferred, albeit not essential configuration. The direction of movement of the strip 10 is indicated by the line 17 to the right of the figures.

Each of the deviations 20 has a single apex 24, preferably lying along a common longitudinal axis 26 of the metal strip and located midway between the parallel marginal edges 12 and 14 and parallel thereto. The angle indicated by the lines 16, 22 is generally between about 2.5° and 7°, and preferably between 3° and 5° as illustrated. By keeping this angle quite small, the extent of stressing of the metal in the region of direction change for the line of the peak 16 is kept at a minimum, but it is nevertheless sufficient to prevent nesting of the confronting surfaces when the corrugated metal sheet is spirally wound or accordion folded in a zig-zag manner back and forth upon itself to build up a catalytic member from a finite length of said strip 10, for example.

FIG. 3 is similar to FIG. 1. The metal strip 30 illustrated is provided with parallel marginal edges 32 and 34. In this embodiment, the configuration of the peaks 36 is in the form of a segment of a curve, preferably sinusoidal, and extending from marginal edge 34 to marginal edge 32. The points of maximum deviation 38 along an imaginary straight line, e.g., dotted line 40, again desirably lie along the median line 42 parallel to and equidistant from the parallel marginal edges 32 and 34. In this embodiment, a tangent 43 to the curved line 36 has a preferred angle of 3° to 5° in the same manner as above described. The cross-section of the strip 30 is as shown in FIG. 2.

FIG. 4 is like FIGS. 1 and 3 except that the apices of V-shaped peak lines have been truncated. Thus, there is shown a thin metal strip 50 having a plurality of peak lines 52 uniformly longitudinally spaced along a midpoint line 54 midway between marginal edges 51 and 53. Each of the corrugation peak lines 52 is, however, trucated to provide a straight segment 56 equidistant at each end 58 and 60 from the parallel marginal edges 51 and 53. Although the slope of the angularly disposed segments 62 and 64 is from about 3° to 5° as above described, it will be noted that the angle between the segment 62 and the straight segment 56 is larger than in the case of the apex angle at 24 in FIG. 1. Hence, the stress riser at the apices 58 in FIG. 4 is less than in FIG. 1 and hence less subject to corrosion. The configuration is nevertheless adequate to prevent nesting when folded or wound as indicated above. The horizontal line 55 is perpendicular to the marginl edges 51 and 53.

FIG. 5 shows an example of a prior art corrugated strip 70. This strip has parallel marginal edges 72 and 74 and an imaginary median line 76 and an imaginary straight line 78 extending perpendiculrly between the marginal edges 72 and 74. It will be observed that each corrugation has, in the embodiment shown 2 chevron apices 80, extending in the direction of movement of the strip 70 through the corrugating rolls (not shown). There is also a reverse chevron apex 82. The chevrons having apices 80 and 82 lie along the imaginary straight line 78. When a core prepared from a corrugated thin metal strip of finite length having corrugations of the type shown in FIG. 5 was accordion folded and inserted in a catalytic converter as a mixed flow honeycomb and run at approximately 2100° F. for about 4 hours, in the exhaust stream of an automotive engine that was purposely run rich, pinhole corrosion sites 84 (FIG. 5) were found to have appeared on every other imaginary line 78 where the apices 82 were in tension.

All of the fragmentary strips shown in FIGS. 1–5 had cross-sections as shown in FIG. 2.

Thus, it can be seen that the number of stress riser points (apices in chevron type corrugations), the direction thereof in relation to the direction of movement through the corrugating rolls, and the sharpness of the apex all have an influence on the resistance to corrosion of a catalytic medium formed from a thin metal sheet having a series of corrugations therein.

What is claimed is:

1. A corrugated thin metal strip of predetermined length and having longitudinally extending marginal edges and being resistant to corrosion at elevated temperatures, said strip being corrugated along its longitudinal axis throughout its length from its leading portion to its trailing portion to provide a longitudinally running series of alternating peaks and valleys, each of said peaks and valleys having a single longitudinally extending displacement across the width of said metal strip which deviates from and returns to an imaginary straight line substantially perpendicular to said marginal edges, said displacement extending in the direction of the leading portion, and the maximum of said displacement from said straight line is in compression.

2. A method for preventing failure by corrosion at elevated temperatures of a non-nesting accordion folded or wound corrugated thin metal strip, said strip having longitudinally extending marginal edges, which comprises corrugating said thin metal strip with a longitudinally running series of peaks and grooves by passing said metal strip through mating corrugating gears, each of said peaks and grooves having a single longitudinally extending displacement across the width of said metal strip which deviates from and returns to an imaginary line substantially perpendicular to the longitudinal marginal edges of said metal strip, said displacement extending in the direction of movement of said strip through the corrugating gears, said metal strip being passed through said corrugating gears such that the longitudinally extending maximum of the displacement is the first of each peak and groove to contact the mating corrugating gears during corrugation and is, therefore, in compression.

3. A method as defined in claim 4 wherein the corrugations have a chevron shape, with the apex included angle being from about 1 60° to about 176°.

* * * * *